United States Patent [19]

Solari Martini et al.

[11] Patent Number: 4,732,664

[45] Date of Patent: Mar. 22, 1988

[54] PROCESS FOR SOLID SEPARATION FROM HYDROPROCESSING LIQUID PRODUCT

[75] Inventors: Rodolfo B. Solari Martini, Los Teques; Roger Marzin; Jose Guitian Lopez, both of San Antonio de los Altos; Jose V. Rodriguez Golding, Caracas; Julio H. Krasuk, Los Teques, all of Venezuela

[73] Assignee: INTEVEP, S.A., Caracas, Venezuela

[21] Appl. No.: 674,874

[22] Filed: Nov. 26, 1984

[51] Int. Cl.[4] ..... C10G 67/02

[52] U.S. Cl. ..... 208/97; 208/112; 208/162; 208/177; 208/96; 210/730; 210/738

[58] Field of Search ..... 208/108, 97, 162, 161, 208/177; 210/729, 730, 738, 634, 781

[56] References Cited

U.S. PATENT DOCUMENTS

| | | | |
|---|---|---|---|
| 2,795,635 | 6/1957 | McBride | 208/96 |
| 3,003,580 | 10/1961 | Lanning | 208/162 |
| 3,221,076 | 11/1965 | Frey et al. | 208/162 |
| 3,575,847 | 4/1971 | Sprow et al. | 208/108 |
| 3,791,956 | 2/1974 | Gorin et al. | 208/10 |
| 3,859,199 | 1/1975 | Gatsis | 208/97 |
| 3,904,509 | 9/1975 | Anthoney | 208/162 |
| 4,040,958 | 8/1977 | Rammler | 208/177 |
| 4,132,630 | 1/1979 | Carr et al. | 208/177 |
| 4,326,948 | 4/1982 | Zang | 208/298 |
| 4,334,976 | 6/1982 | Yan | 208/97 |
| 4,364,819 | 12/1982 | Hutchings et al. | 208/96 |
| 4,428,820 | 1/1984 | Kuehler et al. | 208/10 |
| 4,431,520 | 2/1984 | Giuliani et al. | 208/108 |
| 4,435,276 | 3/1984 | Matsuniya et al. | 208/96 |
| 4,436,615 | 3/1984 | Boodman et al. | 208/177 |
| 4,457,831 | 7/1984 | Gendler | 208/162 |
| 4,465,587 | 8/1984 | Garg et al. | 208/92 |
| 4,470,900 | 9/1984 | Kydd | 208/177 |
| 4,486,295 | 12/1984 | Inooka | 208/96 |
| 4,544,479 | 10/1985 | Yan | 208/106 |

*Primary Examiner*—Helen M. S. Sneed
*Assistant Examiner*—Anthony McFarlane
*Attorney, Agent, or Firm*—Bachman & LaPointe

[57] ABSTRACT

A process for separating finely divided solid particles from a hydroprocessing liquid product which comprises treating a heavy hydrocarbon feed having an asphaltene content of at least 1 wt. % so as to obtain an unstable product characterized by heavy molecular weight molecules which promote the agglomeration of said finely divided solid particles and thereafter feeding said unstable product to a precipitating zone provided with a centrifugal decanter for precipitating the agglomerated solid particles and said heavy molecular weight molecules in said precipitating zone wherein at least 80 wt. % of the finely divided solid particles is recovered.

15 Claims, 2 Drawing Figures

PROCESS FOR SOLID SEPARATION FROM HYDROPROCESSING LIQUID PRODUCT

BACKGROUND OF THE INVENTION

The present invention is drawn to a process for separating out finely divided solid particles from a hydrocarbon liquid product and, more particularly, a process for separating out particles having diameters in the range of 0.1 to 10 microns by means of a centrifugal decanter.

Heretofore, in order to separate out finely divided solid particles having diameters in the range of 0.1 to 10 microns, prior art processes typically required the use of specialized equipment such as a centrifuge having a very high centrifugal acceleration which resulted in high investment costs and high maintenance costs due to high rotation speeds and the erosion resulting from the solid particles in the liquid. Effective separation of finely divided solid particles having diameters in the range of 0.1 to 10 microns, by effective is meant removal of greater than 90 wt. % of the particles and preferably greater than 95 wt. %, has previously not been attainable in processes employing centrifugal decanters which, relatively speaking, are low cost, low maintenance items.

Naturally, it is highly desirable to provide a process for separating out finely divided solid particles from a hydrocarbon liquid product wherein particles in the size range of 0.1 to 10 microns in diameter are efficiently separated. It is particularly useful to remove a high degree of the finely divided solid particles, that is greater than 80 wt. % of the particles, without requiring the need for specialized equipment which results in high maintenance and investment costs.

Accordingly, it is a principal object of the present invention to provide a process for separating out finely divided solid particles from a hydrocarbon liquid product in an efficient and economical manner.

It is a particular object of the present invention to provide a process for separating out finely divided solid particles from a hydrocarbon liquid product wherein the particles have a diameter in the range of 0.1 to 10 microns.

It is a further particular object of the present invention to provide a process for separating out finely divided solid particles having diameters in the range of 0.1 to 10 microns without the necessity of employing specialized equipment.

It is a still further object of the present invention to provide a process for separating out finely divided solid particles having diameters in the range of 0.1 to 10 microns by means of a centrifugal decanter.

Further objects and advantages of the present invention will appear hereinbelow.

SUMMARY OF THE INVENTION

In accordance with the present invention, the foregoing objects and advantages are readily attained.

The present invention relates to a process for removing finely divided solid particles from a hydroprocessing hydrocarbon liquid product. In accordance with the present invention a hydrocarbon feedstock is treated so as to obtain an unstable product which promotes agglomeration of the finely divided solid particles thereby allowing for the separation of the particles by means of a centrifugal decanter. The treatment involved in obtaining the unstable product in accordance with the present invention may be either (1) subjecting the hydrocarbon feedstock to severe hydroprocessing wherein the asphaltene conversion levels are greater than 60%; or (2) by mixing a light hydrocarbon fraction with the hydroprocessed liquid product; or (3) a combination of (1) and (2), above.

In accordance with the present invention the unstable product which results from the treatment of the feedstock as set forth above promotes the agglomeration of the finely divided solid particles which allows for them to be separated out in an effective manner, that is in greater than 80 wt. %, without the need for specialized expensive equipment.

DETAILED DESCRIPTION

Figure 1:
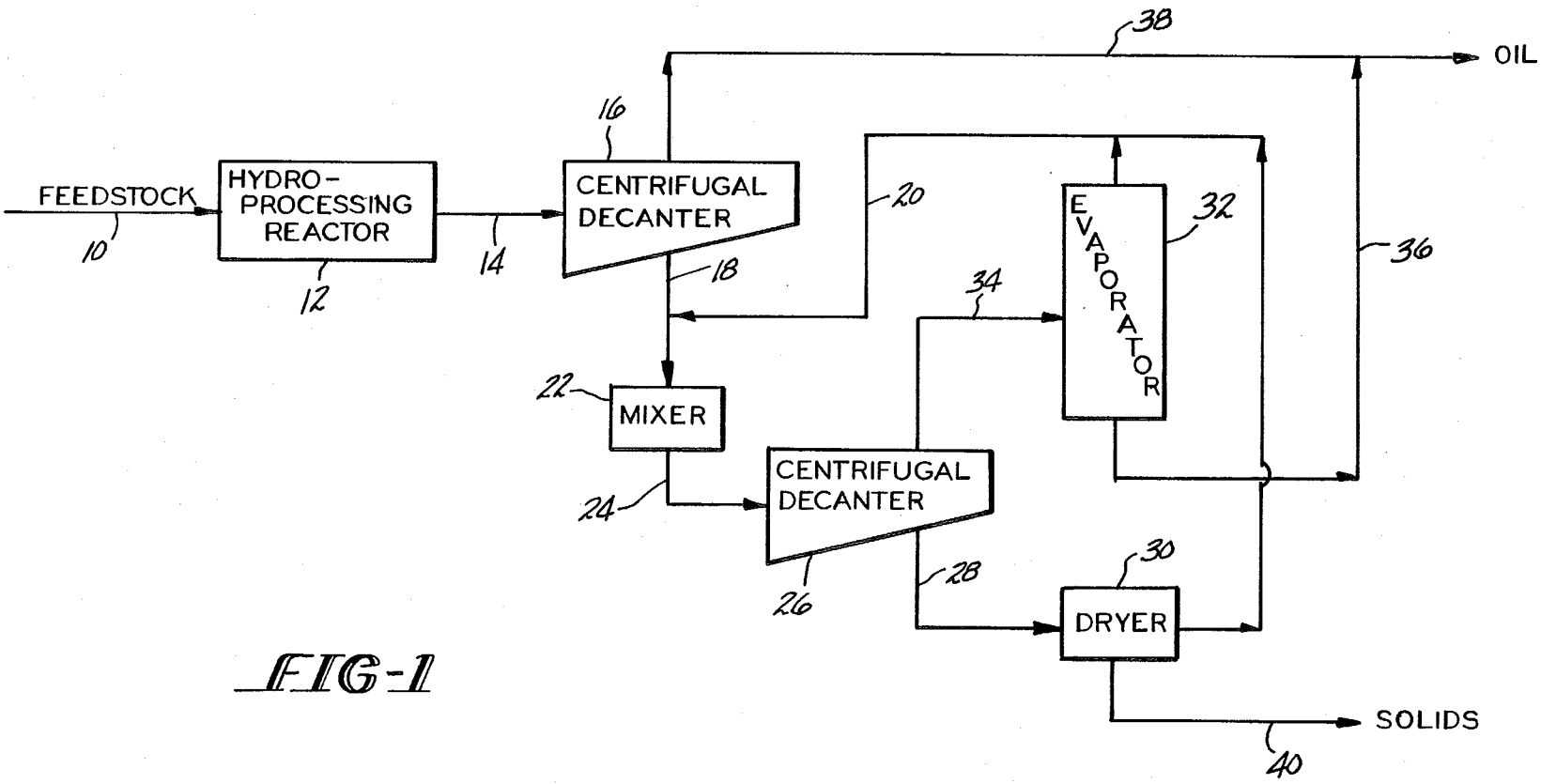
FIG. 1 is a schematic diagram illustrating one flow scheme of the process in accordance with the present invention.

The present invention resides in a process for removing finely divided solid particles from a hydroprocessing hydrocarbon liquid product. By hydroprocessing hydrocarbon liquid product is meant any hydrocarbonaceous material containing asphaltenes which results from the hydroprocessing of heavier hydrocarbon feedstocks. The hydrocarbon feedstocks for which the process of the present invention is particularly well suited are atmospheric or vacuum resids characterized by a high degree of metallic contaminants, sulfur, conradson carbon and asphaltene contents of greater than 1 wt. % and generally greater than 10 wt. %. The hydroprocessing can be of any type such as hydrocracking, hydrovisbreaking, hydroconversion or hydrotreating with or without the addition of a solid catalyst additive to the feedstock prior to hydroprocessing. The solid catalyst additive can be of any type but the preferred ones will be low cost natural catalyst such as laterite, limonite, bauxite, clay, siderite or the more active catalysts such as fresh or used hydrotreating catalysts containing hydrogenating metals such as Co, Mo, Ni such as Co-Mo on alumina, Ni-Mo on alumina, Co-Ni-Mo on alumina, molybdenum soluble compounds or molybdenum suspensions or a porous support or subproducts from other processes such as coke and red mud. The size distribution of the solid additive may range from 0.1 micron to 1 millimeter.

As noted above, the invention is not limited to the addition of the solid in the feedstock which undergoes the hydroprocessing. The solid phase can be the result of feedstock degradation within the conversion process. An example of such formation is the production of coke under high severity hydrovisbreaking processes, in which case the invention can be used to remove the coke from the hydrovisbroken product.

In accordance with the present invention, the hydrocarbon feedstock is treated so as to obtain an unstable product which promotes agglomeration of the finely divided solid particles thereby allowing for the separation of the fine particles by means of a centrifugal decanter which is extremely economical. The unstable product of the present invention may be obtained by either subjecting the hydrocarbon feedstock to severe hydroprocessing under specific conditions or by mixing a light hydrocarbon fraction to the hydroprocessed liquid product or by a combination of severe hydroprocessing followed by a light hydrocarbon fraction addition. The specifics of these treatments are discussed hereinbelow.

It has been observed that when a heavy crude oil feedstock containing more than 50 percent in weight of vacuum resid with an asphaltene level of more than 1 wt. % and generally more than 10 wt. % is subjected to a high severity conversion process, the resulting product is unstable. The term high severity conversion means vacuum resid or asphaltene conversion levels in the range 75 to 100 weight percent. To achieve such conversion levels, temperatures in the range of 420° to 500° C. and pressures in the range of 1000 to 5000 psi are required so that the thermal cracking reactions are faster than the usual catalytic hydrogenation reactions even when using highly active catalysts. Under these severe conditions the hydroconversion product contains unsaturated radicals which can polymerize, forming heavier molecular weight molecule, incompatible with the product. Because the hydroconversion product cannot solvatize these large molecules they will tend to precipitate. Another effect of high severity conversion processes is that a large fraction of the heavier components such as asphaltenes are converted to lighter fractions leavng a small amount of dishydrogenated asphaltenes with a high degree of condensation which are incompatible within the hydroconverted product and therefore will tend to precipitate.

The key to the good separation is that this incompatible material acts as a bonding agent between the finely divided solid particles, increasing in that way their effective particle size. This effect can start in the hydroprocessing reactor and is further increased when the product is cooled down because of the increase in the incompatibility degree. When the product is submitted to moderate centrifugal forces in a centrifugal decanter, the agglomerated solid particles will precipitate together with the incompatible material, giving a very good separation from the hydroconverted liquid oil. Examples of high severity processes where these phenomena occur are the hydrovisbreaking of heavy crudes and the hydrocracking of heavy crudes in the presence of low hydrogenating activity catalysts such as natural catalysts or in the presence of additives which act principally as coke scavengers.

FIG. 1 shows a flow diagram for the separation process of the present invention where the hydrocarbon feedstock is subjected to severe hydroprocessing without the addition of a light solvent. The feedstock is fed via line 10 to a hydroprocessing reactor 12 where the feedstock is subjected to high severity conversion at temperatures of between 380° to 500° C. and pressure of between 1000 to 4500 psi. The hydroconverted product containing the agglomerated solid and incompatible material is fed to a first centrifugal decanter 16 via line 14. This centrifugal decanter 16 is the preferred mechanical device based on the centrifugal force to achieve the separation, because of its high thickening capacity which allows one to obtain a highly concentrated slurry as underflow and reduce the entrainment of oil. The operating conditions of the centrifugal decanter are normally in the temperature range of 20° C. to 300° C., preferably within 80°-200° C. in order to insure a viscosity in the range of 1 cp to 40 cp preferably 1 cp to 15 cp. The design pressure should be higher than the liquid vapor pressure and will be normally in the range of 10 to 70 psi, preferably 15 to 60 psi. The residence time in the centrifugal decanter is between 5 to 1000 seconds, preferably 10 to 200 seconds. The centrifugal decanter is operated at an rpm difference between the rotating case and screw of between 5 to 35 rpm, preferably 5 to 15 rpm and at a g value of 500 to 2500, preferably 700 to 1600. The amount of solid in the feed may range from 0 to 50 percent in weight and preferably within 1 to 20 percent in weight. The underflow containing the separated solid is removed via line 18 and is admixed with fresh solvent from line 20 and make-up solvent from line 21 and fed to a mixing tank 22 under strong agitation in order to wash out the entrained oil from the solids. A solvent/solid ratio in the range of 0.5/1 to 10/1 is used preferably a ratio between 1.1 and 6/1. The solvent to be used may have a boiling range between 80° C. and 300° C. and its aromatic content may range between 0 and 100% depending on the desired degree of removal of the asphaltenes stuck on the solid particles. The resulting slurry of solid, oil and solvent is removed via line 24 and then fed to a second centrifugal decanter 26 which operates at a temperature which insures that the solvent remains in the liquid phase. The underflow from decanter 26 is fed via line 28 to a dryer 30 to recover the solvent impregnated on the solids. The overflow from the decanter 26 is fed to an evaporator 32 via line 34 to obtain the clean oil which is mixed with the overflow 38 from the first centrifugal decanter 16 via line 36. The solvent is recovered in evaporator 32 which after mixing with the solvent recovered in dryer 30 is recycled to the mixing tank 22 via line 20. The dried solids are recovered from the dryer 30 through line 40.

In addition to the treatment set forth, the solid separation from the oil phase can be carried out in a different way which contemplates the addition of a light hydrocarbon fraction to the hydroprocessing liquid product. The effect is very similar to the case previously described since the addition of the light hydrocarbon fraction leads to the incompatibility of the heavier asphaltene molecule in the hydroconversion product/solvent mixture, that is, an unstable product. The precipitated asphaltenes promote the agglomeration of the fine solid particles by acting a bonding or adhesion agent. The effective particle diameter is therefore much bigger than the original size and this effect makes it possible to produce an efficient solid separation even with a low g centrifugal decanter. The degree of solid removal will depend on the degree of incompatibility between the solvent and the hydroconversion product. This incompatibility degree can be varied according to the boiling range of the solvent and its paraffin/aromatic content ratio. An increase in the separation efficiency will be obtained when going from kerosenes of boiling range in the order of 190° C., to 330° C., to naphthas of boiling range 50° C. to 190° C., to mixture of pure components such as pentanes, hexanes, heptanes and octanes. Similarly the separation efficiency will increase when increasing the ratio paraffins/aromatics level. The other parameter which control the separation efficiency is the ratio solvent/hydroconversion product which may vary in the range 0.5/1 to 10/1, preferably between 1/1 and 6/1.

In the case of severe conversion level in the hydroprocessing as set forth above, the separation efficiency described in the previous part can be further enhanced if a light hydrocarbon solvent fraction is added. On the other hand the separation of solid from the hydroconversion product by means of solvent addition is not restrictive on the severity of the conversion level of the previous hydroprocessing stage. The only requirement is that the hydroconverted product must present an asphaltene content of at least 1 percent in weight where the asphaltene is defined as insolubles in N-heptane according to IP 143 procedure. Therefore, the invention can be applied to any type of hydroprocessing where the oil product contains some solid particles and an asphaltene content of at least 1 percent in weight.

Figure 2:
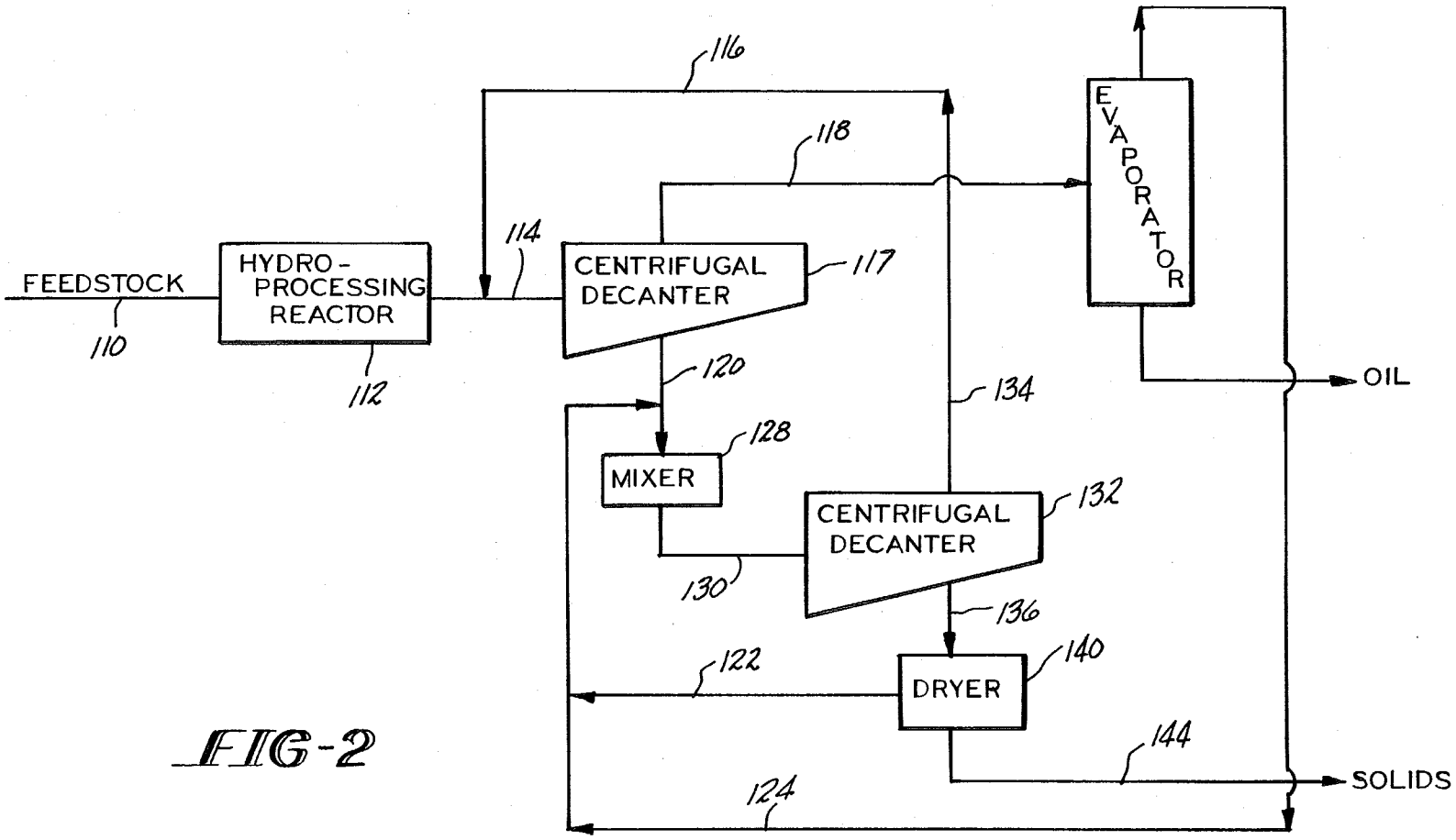
FIG. 2 is a schematic diagram illustrating another flow scheme of the process in accordance with the present invention.

FIG. 2 shows a possible flow diagram for the separation process of the present invention where a light hydrocarbon solvent fraction is added to the hydroprocessing product in order to obtain a high separation efficiency. The feedstock is fed via line 110 to hydroprocessing reactor 112 and the hydroprocessing product containing asphaltene and suspended solid particles is mixed in line 114 with stream 116 containing a hydrocarbon solvent mass fraction higher than 0.8 resulting in the precipitation of the asphaltenes which agglomerate the fine solid particles under the mechanism described above. This precipitation requires a very short contact time and takes place within the line 114 or if desired in any type of inline-mixer. The mixture containing the catalyst-asphaltene flocules is introduced through line 114 to the first centrifugal decanter 117 to separate through line 118 an almost solid free oil solvent mixture and through line 120 a concentrated slurry consisting of catalyst-asphaltene flocules impregnated with said oil-solvent solution. The operating conditions of the decanter 117 are normally fixed in the range of 20° to 300° C. preferably within 80° to 200° C. and at a pressure range between 10 to 70 psi, preferably 15 to 60 psi so as to avoid solvent evaporation. The concentrated slurry of line 120 is contacted with fresh solvent from lines 122 and 124 and make-up solvent from line 121 in line 120 and fed to the mixing tank 128 in order to wash out the oil from the solid flocules. The suspension is fed via line 130 to a second centrifugal decanter 132 to separate a dilute oil-solvent solution through line 134 and a highly concentrated slurry through line 136 of at least 40% solid, being the remainder solvent with only traces of oil. Operating conditions of centrifugal decanter 132 are a temperature in the range 20°–150° C. and pressure high enough to maintain the solvent in the liquid phase as set forth above. Despite the strong agitation in stirred tank 128, the catalyst-asphaltene flocules are not broken and therefore a good solid separation can be easily achieved in the centrifugal decanter 132. The overflow from the second decanter is recycled via line 134 back to the inlet of the first decanter 117, while the underflow is fed via line 136 to a dryer 140 to produce a dried solid product line 144 and a solvent stream 122 which goes, jointly with the solvent recovered in the evaporator, to the mixing tank 128.

The flow scheme presented in FIG. 2 is highly favored by the use of centrifugal decanter which produce an underflow highly concentrated in solids, diminishing in that way the amount of oil entrained in the washing stage and therefore the fraction of oil in the recycle stream. The countercurrent arrangement is also favorable to the economics of the process.

Further advantages of the present invention will be made clear from the following examples:

EXAMPLE 1

A natural catalyst, namely laterite B, with a mean particle size of 3 microns and a size distribution as shown in Table I below was suspended in a 5% wt slurry with kerosene. The suspension having a viscosity of 2.5 cp at the operating temperature of 30° C. was fed to a centrifugal decanter. The decanter was an Escher Wyss centrifugal decanter Model ZDC-20 Scroll type, with a rotor diameter of 25 cm rotating at 3500 rpm, with a differential speed between the rotating case and the rotating screw of 10 rpm and a weir height of 175 mm with an equivalent centrifugal force of 1590 g. At a feed flow rate of 1000 LTS/HR only 50 wt % of the finely divided solid particles were recovered in the underflow from the decanter.

TABLE I

SIZE DISTRIBUTION OF THE SOLIDS USED IN THE SEPARATION TESTS

| Diameter Range (μm) | Laterite B % wt. | Coke % wt. |
|---|---|---|
| <1 | 20 | 18 |
| 1–5 | 57 | 45 |
| 5–10 | 23 | 32 |
| 10–30 | 0 | 4 |
| 30–50 | 0 | 1 |
| >50 | 0 | 0 |

EXAMPLE 2

The vacuum resid of a heavy Venezuelan crude oil, namely Zuata, with an API of 3 and an asphaltene content of 23% wt was submitted to a hydrocracking process using a natural catalyst referred as Laterite B in Table I. This hydrocracking was operated under high severity in order to obtain an 85% conversion of the asphaltenes. After flashing off the atmospheric distillates, the 650° F.+resid containing 7% wt of asphaltene and a catalyst concentration of 10.5% wt was fed to the centrifugal decanter described in Example 1. This slurry was fed at a temperature of 130° C. which reduced the viscosity to 5 cp and at a flow rate of 2000 LTS/HR. Under these conditions 88.2% wt of the original catalyst was recovered in the underflow of the centrifugal decanter. This recovery is much higher than in Example 1 and this comparison illustrates the agglomeration effect produced by the precipitation of the incompatible material formed during the previous hydrocracking stage which was operated at very high severity.

EXAMPLE 3

This example is similar to Example 2, the only difference being the nature of the catalyst used in the hydrocracking stage which in this case was coke of similar size distribution as the catalyst used in Example 2 and referred to in Table I. All remaining conditions were similar and at a flow rate of 2000 LTS/HR 81.2% wt of the initial coke was recovered in the underflow. The slight difference between recoveries in Examples 2 and 3 may be attributed to the density difference between the two catalysts. This example confirms the agglomeration effect and indicates that this effect is independent of the nature of the catalyst used.

EXAMPLE 4

The same heavy crude used in Example 2 was submited to a hydrovisbreaking process with solid catalyst particle additives under such conditions that a 90% conversion of the asphaltene was obtained. After flashing off the atmospheric distillates, the 650° F.+resid containing 5% of asphaltenes and 3.1% wt of solids generated during the hydrovisbreaking process, mainly coke, was fed to the centrifugal decanter described in Example 1, at a temperature of 130° C. which reduced the viscosity to 5 cp. At a flow rate of 2000 LTS/HR a catalyst recovery of 85.3% wt was obtained, indicating that the invention can be applied to high severity processes where the solids are not fed jointly with the feedstock but generated within the conversion process.

EXAMPLE 5

The same hydrocracking product used in Example 2 was fed to the centrifugal decanter after addition of a kerosene cut with a boiling range of 140°-280° C. and a paraffins content of 85% wt. The solvent to oil ratio used was 1/1 in volume. The feed was introduced in the centrifugal decanter at a temperature of 90° C. and at a viscosity of 5 cp. Operating the centrifugal decanter as described in Example 1 at a flow rate of 2000 LTS/HR a catalyst removal of 97.1% wt was achieved. The comparison between Examples 2 and 5 indicate that the addition of a solvent increases the agglomeration effect because of a major asphaltene precipitation.

EXAMPLE 6

Example 5 was repeated, changing the solvent to a naphtha cut with a boiling range of 60° to 170° C. and a paraffins content of 92% wt. At a flow rate of 2000 LTS/HR a major recovery of the catalyst was obtained, 99.1%, indicating that an increase in paraffins content improves the particle recovery.

EXAMPLE 7

Example 6 was repeated, changing the solvent to oil ratio of from 1/1 to 3/1 in volume. The catalyst recovery was furthermore improved, 99.9%, indicating that the solvent/oil ratio is another important parameter which can be varied in order to improve the particle agglomerations and in that way improve the particle recovery.

EXAMPLE 8

Example 7 was repeated, changing the paraffins naphtha to an aromatic naphtha with an aromatic content of 95% and a boiling range of 80° to 200° C. At a low flow rate, 1000 LTS/HR, only 42% of the catalyst was recovered. The dilution with an aromatic solvent does not promote the asphaltene precipitation, therefore awarding the particle agglomeration and yielding a poor particle recovery due to the small particle size of the solids.

EXAMPLE 9

Example 2 was repeated, using a low severity in the hydrocracking step and yielding an asphaltene conversion of only 40% wt. Under these conditions the particle recovery in the centrifugal decanter, without any addition of solvent, was very poor. At 1000 LTS/HR the catalyst recovery was only 47% which indicated that there is no formation of incompatible material and unstable product and therefore no particle agglomeration when using low severity in the conversion step.

EXAMPLE 10

Example 9 was repeated but with the addition of a naphtha cut with a boiling range of 60° to 170° C. and a paraffins content of 92% wt, in the separating stage, similarly to Example 6. A very high particle recovery was obtained, 98.7%, indicating that the invention based on the addition of solvent in the separation stage can be applied to any conversion process without limitations on the degree of severity.

Table II hereinbelow summaries the above examples.

TABLE II

| Example | 1 | 2 | 3 | 4 | 5 | 6 | 7 | 8 | 9 | 10 |
|---|---|---|---|---|---|---|---|---|---|---|
| Original Liquid Feed | Kerosene | Zuata 950° F.+ Resid | Zuata 950° F.+ Resid | Zuata 950° F.+ Resid | Zuata 950° F.+ Resid | Zuata 950° F.+ Resid | Zuata 950° F.+ Resid | Zuata 950° F.+ Resid | Zuata 950° F.+ Resid | Zuata 950° F.+ Resid |
| Original Solid Feed | Laterite B $d_p$ = 3 μm | Laterite B $d_p$ = 3 μm | Coke $d_p$ = 4 μm | None 3 μm | Laterite B $d_p$ = 3 μm | Laterite B $d_p$ = | Laterite B $d_p$ = 3 μm | Laterite B $d_p$ = 3 μm | Laterite B $d_p$ = 3 μm | Laterite B $d_p$ = 3 μm |
| Previous Process | none | hydro-cracking | hydro-cracking | hydrovis-breaking | hydro-cracking | hydro-cracking | hydro-cracking | hydro-cracking | hydro-cracking | hydro-cracking |
| Asphaltene Conversion Level in Previous Process | — | 85 | 87 | 90 | 85 | 85 | 85 | 85 | 40 | 40 |
| Fraction of the Hydro-processing Product Fed to the Separation Stage | — | 650° F.+ resid | 650° F.+ resid | 650° F.+ resid | 650° F.+ resid | 650° F.+ resid | 650° F.+ resid | 650° F.+ resid | 650° F.+ resid | 650° F.+ resid |
| Solvent Added to the Feed to the Centrifugal Decanter | none | none | none | none | Kerosene (140–280° C.) 85% p paraffins | Naphtha (60–170° C.) 92% p paraffins | Naphtha (60–170° C.) 92% p paraffins | Naphtha (80–200° C.) 95% aromatics | none | Naphtha (60–170° C.) 92% p paraffins |
| Ratio Solvent/Oil in Feed to Centrifugal Decanter | — | — | — | — | 1/1 | 1/1 | 3/1 | 1/1 | — | 1/1 |
| Solid Concentration in Oil Fed to Centrifugal Decanter | 5 | 10.5 | 11.2 | 3.1 | 11.2 | 11.2 | 11.2 | 11.2 | 8.2 | 8.2 |

TABLE II-continued

| Example | 1 | 2 | 3 | 4 | 5 | 6 | 7 | 8 | 9 | 10 |
|---|---|---|---|---|---|---|---|---|---|---|
| (% wt) Operating Conditions of the Centrifugal Decanter: | | | | | | | | | | |
| Flow Rate Lt/Hr | 1000 | 2000 | 2000 | 2000 | 2000 | 2000 | 2000 | 1000 | 1000 | 2000 |
| Temperature °C. | 30 | 130 | 130 | 130 | 90 | 50 | 50 | 50 | 130 | 50 |
| Viscosity (cp) | 2.5 | 5 | 7 | 5 | 5 | 5 | 3 | 7 | 7 | 8 |
| Pressure (psi) | 15 | 15 | 15 | 15 | 15 | 15 | 15 | 15 | 15 | 15 |
| Centrifugal Force (G) | 1590 | 1590 | 1590 | 1590 | 1590 | 1590 | 1590 | 1590 | 1590 | 1590 |
| Solid Recovery (% weight) | 50 | 88.2 | 81.2 | 85.3 | 97.1 | 99.1 | 99.9 | 42 | 47 | 98.7 |

As can be seen from the foregoing, extremely effective particle removal is obtained with a centrifugal decanter when hydroprocessing under severe conditions, by mixing a hydrocarbon liquid fraction to the hydroprocessed feedstock or a combination of the two.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for separating finely divided solid particles having a particle size of at least 0.1 microns in diameter from a hydrocracked liquid product consisting essentially of:

(a) providing a petroleum derived hydrocarbon feedstock characterized by a high degree of asphaltene content of greater than about 10 wt. %;

(b) adding a solid catalyst additive to said petroleum derived hydrocarbon feedstock in a concentration of between 0.1 wt. % to 10 wt. % wherein said solid additive has a particle size of at least 0.1 microns in diameter;

(c) hydrocracking said petroleum dervied hydrocarbon feedstock in the presence of said solid catalyst additive in a hydrocracking reactor under high severity conditions wherein asphaltene conversion levels are greater than 60% so as to obtain an unstable product characterized by an asphaltene content of at least 1 wt. % and polymerized unsaturated radicals which promote the agglomeration of said solid catalyst particles;

(d) removing said unstable product from said hydrocracking reactor;

(e) mixing said unstable product with solvent in a solvent to unstable product ratio of between 5/1 to 10/1 so as to obtain an unstable product/solvent mixture wherein said solvent is a hydrocarbon cut having a boiling range of between 50° to 350° C. with a paraffinic content of greater than 50 wt. %;

(f) feeding said unstable product/solvent mixture to a first precipitating zone; and (g) precipitating the agglomerated solid catalyst particles in said first precipitating zone wherein greater than 80 wt. % of said solid particles are removed.

2. A process for separating finely divided solid particles having a particles size of at least 0.1 microns in diameter from a hydrocracked liquid product consisting essentially of:

(a) providing a petroleum derived hydrocarbon feedstock characterized by a high degree of asphaltene content of greater than about 10 wt. %;

(b) adding a solid catalyst additive to said petroleum derived hydrocarbon feedstock in a concentration of between 0.1 wt. % to 10 wt. % wherein said solid additive has a particle size of at least 0.1 microns in diameter;

(c) hydrocracking said petroleum derived hydrocarbon feedstock in the presense of said solid catalyst additive in a hydrocracking reactor under high severity conditions wherein asphaltene conversion levels are greater than 75% so as to obtain an unstable product characterized by an asphaltene content of at least 1 wt. % and polymerized unsaturated radicals which promote the agglomeration of said solid catalyst particles;

(d) removing said unstable product from said hydrocracking reactor;

(e) mixing said unstable product with solvent in a solvent to unstable product ratio of between 5/1 to 10/1 so as to obtain an unstable product/solvent mixture wherein said solvent is a hydrocarbon cut having a boiling range of between 50° to 350° C. with a paraffinic content of greater than 85 wt. %;

(f) feeding said unstable product/solvent mixture to a first precipitating zone; and (g) precipitating the agglomerated solid catalyst particles in said first precipitating zone wherein at least 97 wt. % of said solid particles are removed.

3. A process according to claims 1 or 2 wherein said hydrocracking takes place at a temperature range of between 380° C. to 500° C. and at a pressure range of between 1000 psi to 4500 psi.

4. A process according to claims 1 or 2 wherein said solid additive has a size distribution of between 0.1 micron to 1 mm in diameter.

5. A process according to claims 1 or 2 including providing a scroll centrifugal decanter in said first precipitating zone.

6. A process according to claim 5 wherein said agglomerated solid particles are precipitated in said first precipitating zone under the following operating conditions:

Temperature: 20° to 300° C.
Pressure: 10 to 70 psi
Residence Time: 5 to 1000 sec.
rpm Difference: 5 to 35 rpm
g value: 500 to 2500
viscosity: 1 to 40 cp.

7. A process according to claim 5 wherein said agglomerated solid particles are precipitated in said precipitating zone under the following operating conditions:

Temperature: 80° to 200° C.
Pressure: 15 to 60 psi
Residence Time: 10 to 200 sec.
rpm Difference: 5 to 15 rpm
g value: 700 to 1600
viscosity: 1 to 15 cp.

8. A process according to claim 5 wherein the underflow containing entrained oil is removal from said first precipitating zone and mixing said underflow in a mixing zone with a solvent in a solvent/oil ratio of between 0.5/1 to 10/1.

9. A process according to claim 8 wherein said solvent has a boiling point range of between 80° to 300° C.

10. A process according to claim 8 wherein the solvent/oil slurry is fed to a second precipitating zone under the following operating conditions:

Temperature: 20° to 300° C.
Pressure: 10 to 70 psi
Residence Time: 5 to 1000 sec.
rpm Difference: 5 to 35 rpm
g value: 500 to 2500
viscosity: 1 to 40 cp.

11. A process according to claim 8 wherein the solvent/oil slurry is fed to a second precipitating zone under the following operating conditions:

Temperature: 80° to 200° C.
Pressure: 15 to 60 psi
Residence Time: 10 to 200 sec.
rpm Difference: 5 to 15 rpm
g value: 700 to 1600
viscosity: 1 to 15 cp.

12. A process according to claim 10 wherein the underflow is removed from said second precipitating zone, feeding said underflow to a dryer where said solvent is recovered and recycling said solvent to said mixing zone.

13. A process according to claim 8 wherein said solvent is a hydrocarbon cut having a boiling range of between 50° to 350° C. with a paraffin content of between 50 to 100 wt. %.

14. A process according to claim 10 wherein a scroll centrifugal decanter is provided in said second precipitating zone.

15. A process according to claim 14 wherein said agglomerated solid particles are precipitated in said second precipitating zone under the following operating conditions:

Temperature: 20° to 300° C.
Pressure: 10 to 70 psi
Residence Time: 5 to 1000 sec.
rpm Difference: 5 to 35 rpm
g value: 500 to 2500
viscosity: 1 to 40 cp.

* * * * *